US011361708B2

(12) United States Patent
Wu et al.

(10) Patent No.: US 11,361,708 B2
(45) Date of Patent: Jun. 14, 2022

(54) PIXEL CIRCUIT, PIXEL DRIVING METHOD AND DISPLAY DEVICE

(71) Applicant: BOE TECHNOLOGY GROUP CO., LTD., Beijing (CN)

(72) Inventors: Qian Wu, Beijing (CN); Longfei Fan, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 17/307,996

(22) Filed: May 4, 2021

(65) Prior Publication Data

US 2022/0101776 A1 Mar. 31, 2022

(30) Foreign Application Priority Data

Sep. 28, 2020 (CN) ..... 202011041969.5

(51) Int. Cl.
*G09G 3/32* (2016.01)
*G09G 3/20* (2006.01)

(52) U.S. Cl.
CPC ..... *G09G 3/32* (2013.01); *G09G 3/2014* (2013.01); *G09G 2300/0809* (2013.01); *G09G 2310/061* (2013.01); *G09G 2310/08* (2013.01)

(58) Field of Classification Search
CPC ..... G09G 3/2014; G09G 3/32–3291; G09G 2300/0421; G09G 2300/0426; G09G 2300/0439; G09G 2300/0452; G09G 2300/0465; G09G 2300/0809; G09G 2300/0819; G09G 2300/0828–0838; G09G 2300/0842; G09G 2300/0852; G09G 2300/0861; G09G 2300/0866; G09G 2300/0876; G09G 2310/0202; (Continued)

(56) References Cited

U.S. PATENT DOCUMENTS

2017/0124941 A1* 5/2017 Na ..... G09G 3/3208
2018/0240399 A1* 8/2018 Lin ..... G09G 3/32
2021/0174736 A1* 6/2021 Yang ..... G09G 3/3233

FOREIGN PATENT DOCUMENTS

WO WO-2020001635 A1 * 1/2020 ..... G09G 3/2074

* cited by examiner

*Primary Examiner* — Nathan Danielsen
(74) *Attorney, Agent, or Firm* — McCoy Russell LLP

(57) ABSTRACT

A pixel circuit, a pixel driving method and a display device are provided in the present disclosure. The pixel circuit includes a light-emitting element, a pixel driving circuit, an on-off control circuit and a light-emission time control circuit. A control terminal of the on-off control circuit is electrically coupled to the light-emission time control circuit, and the on-off control circuit is configured to control a driving current output terminal to be coupled to, or decoupled from, the light-emitting element under the control of a potential at the control terminal of the on-off control circuit. The light-emission time control circuit is configured to control an $n^{th}$ light-emission time control signal output terminal to be coupled to, or decoupled from, the control terminal of the on-off control circuit in accordance with an $n^{th}$ light-emission control data voltage under the control of a second gate driving signal. N is an integer larger than 1, and n is a positive integer smaller than or equal to N.

20 Claims, 6 Drawing Sheets

(58) Field of Classification Search
CPC ... G09G 2310/0205; G09G 2310/0248; G09G 2310/0251; G09G 2310/0267–0275; G09G 2310/0289; G09G 2310/06; G09G 2310/066; G09G 2310/067; G09G 2310/08; G09G 2320/0242; G09G 2320/0271; G09G 2320/0276; G09G 2320/029; G09G 2320/0295; G09G 2320/043–048; G09G 2320/0613–0653; G09G 2320/0666; G09G 2330/028
See application file for complete search history.

PIXEL CIRCUIT, PIXEL DRIVING METHOD AND DISPLAY DEVICE

CROSS-REFERENCE TO RELATED APPLICATION

The present application claims priority to Chinese Patent Application No. 202011041969.5 filed on Sep. 28, 2020. The entire contents of the above-listed application is hereby incorporated by reference for all purposes.

TECHNICAL FIELD

The present disclosure relates to the field of display technologies, in particular to a pixel circuit, a pixel driving method and a display device.

BACKGROUND

An micro light-emitting diode (LED) is formed by using a LED miniaturization technology, which is referred to as that conventional LEDs are arranged in array, miniaturized, addressed and massively transferred to a circuit board to form ultra-fine-pitch LEDs, and a LED length of a millimeter-level is miniaturized to be of a micron-level, thereby to provide ultra-large pixels per inch and ultra-high resolution.

In a Micro LED pixel circuit in the related art, an equivalent current in the entire circuit is controlled by a driving current for driving the micro LED and a duration when the micro LED emits light. In a pulse control method, a long light-emission control signal is applied within a first time period, a short light-emission control signal is applied within a second time period, and whether the pixel circuit operates at the long light-emission control signal or the short light-emission control signal is controlled by a light-emission control data voltage, which is finished within at least two time periods. Therefore, an available time within each time period is reduced, and the pulse control method is merely suitable for a low-resolution micro LED product. For a high-resolution product, it is not be able to finish the scanning for each row due to an insufficient time.

SUMMARY

A pixel circuit is provided, including a light-emitting element, a pixel driving circuit, an on-off control circuit and a light-emission time control circuit. The pixel driving circuit is electrically coupled to a first gate line, a display data line, a light-emission control line, a first voltage terminal and the on-off control circuit, and configured to apply a driving current through a driving current output terminal in accordance with a display data voltage from the display data line under the control of a first gate driving signal from the first gate line and a light-emission control signal from the light-emission control line. A control terminal of the on-off control circuit is electrically coupled to the light-emission time control circuit, a first terminal of the on-off control circuit is electrically coupled to the driving current output terminal, and a second terminal of the on-off control circuit is electrically coupled to the light-emitting element. The on-off control circuit is configured to control the driving current output terminal to be coupled to, or decoupled from, the light-emitting element under the control of a potential at the control terminal of the on-off control circuit. The light-emission time control circuit is electrically coupled to a second gate line, light-emission control data lines, N light-emission time control signal output terminals and the control terminal of the on-off control circuit, and configured to control an $n^{th}$ light-emission time control signal output terminal to be coupled to, or decoupled from, the control terminal of the on-off control circuit in accordance with an $n^{th}$ light-emission control data voltage from an $n^{th}$ light-emission control data line under the control of a second gate driving signal from the second gate line. The $n^{th}$ light-emission time control signal output terminal is configured to apply an $n^{th}$ light-emission time control signal, N is an integer larger than 1, and n is a positive integer smaller than or equal to N.

Optionally, the light-emission time control circuit includes N light-emission time control sub-circuits. An $n^{th}$ light-emission time control sub-circuit is electrically coupled to the second gate line, the $n^{th}$ light-emission control data line, the $n^{th}$ light-emission time control signal output terminal and the control terminal of the on-off control circuit, and configured to write the $n^{th}$ light-emission control data voltage into an $n^{th}$ control node under the control of the second gate driving signal from the second gate line, maintain a potential at the $n^{th}$ control node, and control the $n^{th}$ light-emission time control signal output terminal to be coupled to, or decoupled from, the control terminal of the on-off control circuit under the control of the potential at the $n^{th}$ control node.

Optionally, the $n^{th}$ light-emission time control sub-circuit includes an $n^{th}$ first control sub-circuit and an $n^{th}$ second control sub-circuit. A control terminal of the $n^{th}$ first control sub-circuit is electrically coupled to the second gate line, and a first terminal of the $n^{th}$ first control sub-circuit is electrically coupled to the $n^{th}$ light-emission control data line, a second terminal of the $n^{th}$ first control sub-circuit is electrically coupled to the $n^{th}$ control node, and the $n^{th}$ first control sub-circuit is configured to control the $n^{th}$ light-emission control data line to be coupled to, or decoupled from, the $n^{th}$ control node under the control of the second gate driving signal and maintain the potential at the $n^{th}$ control node. A control terminal of the $n^{th}$ second control sub-circuit is electrically coupled to the $n^{th}$ control node, and a first terminal of the $n^{th}$ second control sub-circuit is electrically coupled to the $n^{th}$ light-emission time control signal output terminal, a second terminal of the $n^{th}$ second control sub-circuit is electrically coupled to the control terminal of the on-off control circuit, and the $n^{th}$ second control sub-circuit is configured to control the $n^{th}$ light-emission time control signal output terminal to be coupled to, or decoupled from, the control terminal of the on-off control circuit under the control of the potential at the $n^{th}$ control node.

Optionally, n is equal to 2, a first-first control sub-circuit includes a first control transistor and a first capacitor, and a first-second control sub-circuit includes a second control transistor. A control electrode of the first control transistor is electrically coupled to the second gate line, a first electrode of the first control transistor is electrically coupled to the first light-emission control data line, and a second electrode of the first control transistor is electrically coupled to a first control node. A first terminal of the first capacitor is electrically coupled to the first control node, and a second terminal of the first capacitor is electrically coupled to a second voltage terminal. A control electrode of the second control transistor is electrically coupled to the first control node, a first electrode of the second control transistor is electrically coupled to a first light-emission time control signal output terminal, and a second electrode of the second control transistor is electrically coupled to the control terminal of the on-off control circuit.

Optionally, a second-first control sub-circuit includes a third control transistor and a second capacitor, and a second-second control sub-circuit includes a fourth control transistor. A control electrode of the third control transistor is electrically coupled to the second gate line, a first electrode of the third control transistor is electrically coupled to a second light-emission control data line, and a second electrode of the third control transistor is electrically coupled to a second control node. A first terminal of the second capacitor is electrically coupled to the second control node, and a second terminal of the second capacitor is electrically coupled to the second voltage terminal. A control electrode of the fourth control transistor is electrically coupled to the second control node, a first electrode of the fourth control transistor is electrically coupled to a second light-emission time control signal output terminal, and a second electrode of the fourth control transistor is electrically coupled to the control terminal of the on-off control circuit.

Optionally, the first control transistor and the third control transistor are each a p-type transistor; or, the first control transistor and the third control transistor are each an n-type transistor.

Optionally, N is equal to 2, and a first light-emission control data line and a second light-emission control data line are a same light-emission control data line. The light-emission time control circuit includes a fifth control transistor, a sixth control transistor, a seventh control transistor and a third capacitor. A control electrode of the fifth control transistor is electrically coupled to the second gate line, a first electrode of the fifth control transistor is electrically coupled to the first light-emission control data line, and a second electrode of the fifth control transistor is electrically coupled to a control electrode of the sixth control transistor and a control electrode of the seventh control transistor. A first terminal of the third capacitor is electrically coupled to the control electrode of the sixth control transistor, and a second terminal of the third capacitor is electrically coupled to a second voltage terminal. A first electrode of the sixth control transistor is electrically coupled to a first light-emission time control signal output terminal, and a second electrode of the sixth control transistor is electrically coupled to the control terminal of the on-off control circuit. A first electrode of the seventh control transistor is electrically coupled to a second light-emission time control signal output terminal, and a second electrode of the seventh control transistor is electrically coupled to the control terminal of the on-off control circuit.

Optionally, the sixth control transistor is an n-type transistor, and the seventh control transistor is a p-type transistor; or, the sixth control transistor is a p-type transistor, and the seventh control transistor is an n-type transistor.

Optionally, the on-off control circuit includes an on-off control transistor, a control electrode of which is the control terminal of the on-off control circuit, a first electrode of which is electrically coupled to the driving current output terminal, and a second electrode of which is electrically coupled to the light-emitting element.

Optionally, the pixel driving circuit includes a driving sub-circuit, a data written-in sub-circuit, a light-emission control sub-circuit, an energy storage sub-circuit and a compensation sub-circuit. The data written-in sub-circuit is electrically coupled to the first gate line, the display data line and a first terminal of the driving sub-circuit, and configured to write the display data voltage into the first terminal of the driving sub-circuit under the control of the first gate driving signal. The compensation sub-circuit is electrically coupled to the first gate line, a control terminal of the driving sub-circuit and a second terminal of the driving sub-circuit, and configured to control the control terminal of the driving sub-circuit to be coupled to, or decoupled from, the second terminal of the driving sub-circuit under the control of the first gate driving signal. A first terminal of the energy storage sub-circuit is electrically coupled to the control terminal of the driving sub-circuit, a second terminal of the energy storage sub-circuit is electrically coupled to the first voltage terminal, and the energy storage sub-circuit is configured to maintain a potential at the control terminal of the driving sub-circuit. The light-emission control sub-circuit is electrically coupled to the light-emission control line, the first voltage terminal, the first terminal of the driving sub-circuit, the second terminal of the driving sub-circuit and the first terminal of the on-off control circuit, and configured to control the first voltage terminal to be coupled to, or decoupled from, the first terminal of the driving sub-circuit and control the second terminal of the driving sub-circuit to be coupled to, or decoupled from, the first terminal of the on-off control circuit under the control of the light-emission control line. The driving sub-circuit is configured to generate the driving current under the control of the potential at the control terminal of the driving sub-circuit.

Optionally, the pixel driving circuit further includes a resetting sub-circuit electrically coupled to a resetting control terminal, an initial voltage terminal and the control terminal of the driving sub-circuit, and configured to write an initial voltage at the initial voltage terminal into the control terminal of the driving sub-circuit under the control of a resetting control signal at the resetting control terminal.

Optionally, the data written-in sub-circuit includes a data written-in transistor, the compensation sub-circuit includes a compensation transistor, and the light-emission control sub-circuit includes a first light-emission control transistor and a second light-emission control transistor, the driving sub-circuit includes a driving transistor, the energy storage sub-circuit includes a storage capacitor, and the resetting sub-circuit includes a resetting transistor. A control electrode of the data written-in transistor is electrically coupled to the first gate line, a first electrode of the data written-in transistor is electrically coupled to the display data line, and a second electrode of the data written-in transistor is electrically coupled to a first electrode of the driving transistor. A control electrode of the compensation transistor is electrically coupled to the first gate line, a first electrode of the compensation transistor is electrically coupled to a control electrode of the driving transistor, and a second electrode of the compensation transistor is electrically coupled to a second electrode of the driving transistor. A control electrode of the first light-emission control transistor is electrically coupled to the light-emission control line, a first electrode of the first light-emission control transistor is electrically coupled to the first voltage terminal, and a second electrode of the first light-emission control transistor is electrically coupled to the first electrode of the driving transistor. A control electrode of the second light-emission control transistor is electrically coupled to the light-emission control line, a first electrode of the second light-emission control transistor is electrically coupled to the second electrode of the driving transistor, and a second electrode of the second light-emission control transistor is electrically coupled to the first terminal of the on-off control circuit. A first terminal of the storage capacitor is electrically coupled to the first voltage terminal, and a second terminal of the storage capacitor is electrically coupled to the control electrode of the driving transistor. A control electrode of the resetting transistor is electrically coupled to the resetting control terminal, a first electrode of the resetting transistor is electrically coupled to the initial voltage terminal, and a second electrode of the resetting transistor is electrically coupled to the control electrode of the driving transistor.

Optionally, the light-emitting element is a micro light-emitting diode, the second terminal of the on-off control circuit is electrically coupled to an anode of the micro light-emitting diode, and a cathode of the micro light-emitting diode is electrically coupled to a third voltage terminal.

A pixel driving method for driving the above-mentioned pixel circuit is further provided, including: applying, by the pixel driving circuit, a driving current for driving the light-emitting element to emit light through the driving current output terminal in accordance with a display data voltage under the control of a first gate driving signal and a light-emission control signal; controlling, by the on-off control circuit, the driving current output terminal to be coupled to, or decoupled from, the light-emitting element under the control of a potential at the control terminal of the on-off control circuit; and controlling, by the light-emission time control circuit, the $n^{th}$ light-emission time control signal output terminal to be coupled to, or decoupled from, the control terminal of the on-off control circuit in accordance with an $n^{th}$ light-emission control data voltage under the control of a second gate driving signal; where n is a positive integer smaller than or equal to N, and N is an integer larger than 1.

A display device including the above-mentioned pixel circuit is further provided in the present disclosure.

DETAILED DESCRIPTION

Figure 1:
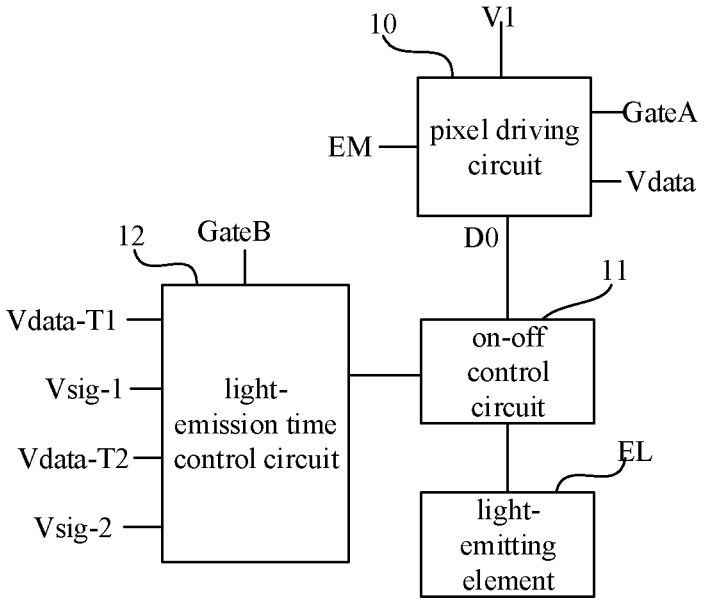
FIG. 1 is a schematic view showing a pixel circuit according to one embodiment of the present disclosure.

The technical solutions in the embodiments of the present disclosure will be described hereinafter clearly with reference to the drawings of the embodiments of the present disclosure. Obviously, the following embodiments merely relate to a part of, rather than all of, the embodiments of the present disclosure, and based on these embodiments, a person of ordinary skill in the art may, without any creative effort, obtain other embodiments, which also fall within the scope of the present disclosure.

A main objective of the present disclosure is to provide a pixel circuit, a pixel driving method and a display device, so as to solve a problem that a light-emission time control in the related art needs to be finished in multiple time periods, which is not suitable for the display of a high-resolution micro light-emitting diode (LED).

The pixel circuit includes a light-emitting element, a pixel driving circuit, an on-off control circuit and a light-emission time control circuit. The pixel driving circuit is electrically coupled to a first gate line, a display data line, a light-emission control line, a first voltage terminal and the on-off control circuit, and configured to apply a driving current through a driving current output terminal in accordance with a display data voltage from the display data line under the control of a first gate driving signal from the first gate line and a light-emission control signal from the light-emission control line.

A control terminal of the on-off control circuit is electrically coupled to the light-emission time control circuit, a first terminal of the on-off control circuit is electrically coupled to the driving current output terminal, and a second terminal of the on-off control circuit is electrically coupled to the light-emitting element. The on-off control circuit is configured to control the driving current output terminal to be coupled to, or decoupled from, the light-emitting element under the control of a potential at the control terminal of the on-off control circuit.

The light-emission time control circuit is electrically coupled to a second gate line, light-emission control data lines, N light-emission time control signal output terminals and the control terminal of the on-off control circuit, and configured to control an $n^{th}$ light-emission time control signal output terminal to be coupled to, or decoupled from, the control terminal of the on-off control circuit in accordance with an $n^{th}$ light-emission control data voltage from an $n^{th}$ light-emission control data line under the control of a second gate driving signal from the second gate line. The $n^{th}$ light-emission time control signal output terminal is configured to apply an $n^{th}$ light-emission time control signal, where N is an integer larger than 1, and n is a positive integer smaller than or equal to N.

A pixel circuit suitable for micro LED is provided in the embodiment of the present disclosure. Since a luminous efficiency of the micro LED changes along with a current density, and a chromaticity coordinate also changes along with the current density, it is necessary to make the micro LED always operate at a high current density in actual operation, and control a duration when the micro LED emits light by using a pulse width control method, thereby to control the brightness and grayscale.

At least two light-emission time control signals (the light-emission time control signal may be, but not limited to, a pulse signal that controls the on-off control circuit to control the driving current output terminal to be coupled or decoupled from the light-emitting element) may be applied at the same time in the pixel circuit of embodiment of the present disclosure. Therefore, it is able to solve the problem that the light-emission time control needs to be finished in multiple time periods, save the time, and be suitable for the display of the high-resolution Micro LED.

In the embodiment of the present disclosure, N light-emission time control signals may be applied to the light-emission time control circuit at the same time, and within the light-emission time period, under the control of the light-emission control data voltage from the light-emission control data line, one of the N light-emission time control signals is selected and applied to the control terminal of the on-off control circuit, so as to control the on-off control circuit to turn on or off coupling between the driving current output terminal and the light-emitting element. A duration when the light-emitting element emits light is controlled, so as to adjust the grayscale and brightness. Thus, luminescence of corresponding grayscale values for each light-emitting element may be finished within one scanning period, and it is able to solve the problem that the light-emission time control needs to be finished in multiple time periods, save the time, and be suitable for the display of the high-resolution Micro LED.

In the embodiment of the present disclosure, the first voltage terminal may be, but not limited to, a high voltage terminal.

During the implementation, N may be an integer equal to or larger than 1. For example, N may be, but not limited to, 2, 3 or 4.

In the case that N is equal to 2, as shown in FIG. 1, the above-mentioned pixel circuit includes a light-emitting element EL, a pixel driving circuit 10, an on-off control circuit 11 and a light-emission time control circuit 12.

The pixel driving circuit 10 is electrically coupled to a first gate line GateA, a display data line, a light-emission control line EM, a first voltage terminal V1 and the on-off control circuit 11, and configured to apply a driving current for driving the light-emitting element EL to emit light through a driving current output terminal DO in accordance with a display data voltage Vdata from the display data line under the control of a first gate driving signal from the first gate line GateA and a light-emission control signal from the light-emission control line EM.

A control terminal of the on-off control circuit 11 is electrically coupled to the light-emission time control circuit 12, a first terminal of the on-off control circuit 11 is electrically coupled to the driving current output terminal DO, and a second terminal of the on-off control circuit 11 is electrically coupled to the light-emitting element EL. The on-off control circuit is configured to control the driving current output terminal DO to be coupled to, or decoupled from, the light-emitting element EL under the control of a potential at the control terminal of the on-off control circuit.

The light-emission time control circuit 12 is electrically coupled to a second gate line GateB, a first light-emission control data line, a second light-emission control data line, a first light-emission time control signal output terminal, a second light-emission time control signal output terminal and the control terminal of the on-off control circuit 11, and configured to, under the control of a second gate driving signal from the second gate line GateB, control the first light-emission time control signal output terminal to be coupled to, or decoupled from, the control terminal of the on-off control circuit 11 in accordance with a first light-emission control data voltage Vdata_T1 from the first light-emission control data line, and control the second light-emission time control signal output terminal to be coupled to, or decoupled from, the control terminal of the on-off control circuit 11 in accordance with a second light-emission control data voltage Vdata_T2 from the second light-emission control data line.

The first light-emission time control signal output terminal is configured to apply a first light-emission time control signal V-sig1, and the second light-emission time control signal output terminal is configured to apply a second light-emission time control signal V-sig2.

When the pixel circuit shown in FIG. 1 is in operation, a display period includes a charging stage and a light-emission stage arranged one after another, and the charging stage includes a first charging time period and a second charging time period arranged one after another.

In the first charging time period of the charging stage, GateA is turned on to control Vdata to be written into an energy storage sub-circuit in the pixel driving circuit, and both GateB and EM are turned off.

In the second charging time period of the charging stage, GateA is turned off, EM is turned off, and GateB is turned on to control Vdata-T1 and Vdata-T2 to be written into corresponding capacitors in the light-emission time control circuit 12, respectively, for controlling the subsequent current output.

In the light-emission stage, EM is turned on, and GateA and GateB are turned off. V-sig1 and V-sig2 are pulse signals of different duty ratios. The light-emission time control circuit 12 is configured to write V-sig1 or V-sig2 into the control terminal of the on-off control circuit 11 under the control of Vdata-T1 and Vdata-T2, so as to control a duration when the light-emitting element EL emits light within one display period.

In the embodiment of the present disclosure, V-sig1 and V-sig2 may be applied by a driving integrated circuit (IC).

In the embodiment of the present disclosure, when GateA is turned on, it means, but not limited to, that a valid first gate driving signal is applied from GateA to turn on a data written-in transistor of which a control electrode is electrically coupled to GateA.

When GateB is turned on, it means, but not limited to, that a valid second gate driving signal is applied from GateB to turn on a transistor of which a control electrode is coupled to GateB.

When EM is turned on, it means, but not limited to, that a valid light-emission control signal is applied from EM to turn on a first light-emission control transistor and a second light-emission control transistor each of which a control electrode is coupled to EM.

During the implementation, the first light-emission control data line and the second light-emission control data line may be different light-emission control lines, or a same light-emission control data line.

During the implementation, the light-emission time control circuit may include N light-emission time control sub-circuits.

An $n^{th}$ light-emission time control sub-circuit is electrically coupled to the second gate line, the $n^{th}$ light-emission control data line, the $n^{th}$ light-emission time control signal output terminal and the control terminal of the on-off control circuit, and configured to write the $n^{th}$ light-emission control data voltage from an $n^{th}$ light-emitting control data line into an $n^{th}$ control node under the control of the second gate driving signal from the second gate line, maintain a potential at the $n^{th}$ control node, and control the $n^{th}$ light-emission time control signal output terminal to be coupled to, or decoupled from, the control terminal of the on-off control circuit under the control of the potential at the $n^{th}$ control node.

Figure 2:
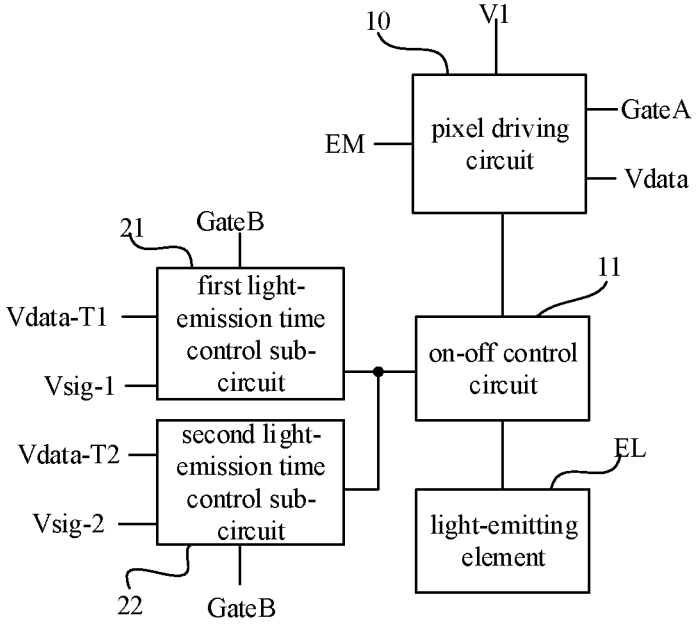
FIG. 2 is another schematic view showing the pixel circuit according to one embodiment of the present disclosure.

As shown in FIG. 2, on the basis of the pixel circuit in FIG. 1, the light-emission time control circuit may include a first light-emission time control sub-circuit 21 and a second light-emission time control sub-circuit 22.

The first light-emission time control sub-circuit 21 is electrically coupled to the second gate line GateB, the first light-emission control data line, the first light-emission time control signal output terminal and the control terminal of the on-off control circuit 11, and configured to write the first light-emission control data voltage Vdata-T1 from the first light-emission control data line into a first control node under the control of the second gate driving signal from the second gate line GateB, maintain a potential at the first control node, and control the first light-emission time control signal output terminal to be coupled to, or decoupled from, the control terminal of the on-off control circuit 11 under the control of the potential at the first control node.

The second light-emission time control sub-circuit 22 is electrically coupled to the second gate line GateB, the second light-emission control data line, the second light-emission time control signal output terminal and the control terminal of the on-off control circuit 11, and configured to write the second light-emission control data voltage Vdata-T2 from the second light-emission control data line into a second control node under the control of the second gate driving signal from the second gate line GateB, maintain a potential at the second control node, and control the second light-emission time control signal output terminal to be coupled to, or decoupled from, the control terminal of the on-off control circuit 11 under the control of the potential at the second control node.

Optionally, the $n^{th}$ light-emission time control sub-circuit includes an $n^{th}$ first control sub-circuit and an $n^{th}$ second control sub-circuit.

A control terminal of the $n^{th}$ first control sub-circuit is electrically coupled to the second gate line, and a first terminal of the $n^{th}$ first control sub-circuit is electrically coupled to the $n^{th}$ light-emission control data line, a second terminal of the $n^{th}$ first control sub-circuit is electrically coupled to the $n^{th}$ control node. The $n^{th}$ first control sub-circuit is configured to control the $n^{th}$ light-emission control data line to be coupled to, or decoupled from, the $n^{th}$ control node under the control of the second gate driving signal and maintain the potential at the $n^{th}$ control node.

A control terminal of the $n^{th}$ second control sub-circuit is electrically coupled to the $n^{th}$ control node, and a first terminal of the $n^{th}$ second control sub-circuit is electrically coupled to the $n^{th}$ light-emission time control signal output terminal, a second terminal of the $n^{th}$ second control sub-circuit is electrically coupled to the control terminal of the on-off control circuit. The $n^{th}$ second control sub-circuit is configured to control the $n^{th}$ light-emission time control signal output terminal to be coupled to, or decoupled from, the control terminal of the on-off control circuit under the control of the potential at the $n^{th}$ control node.

Figure 3:
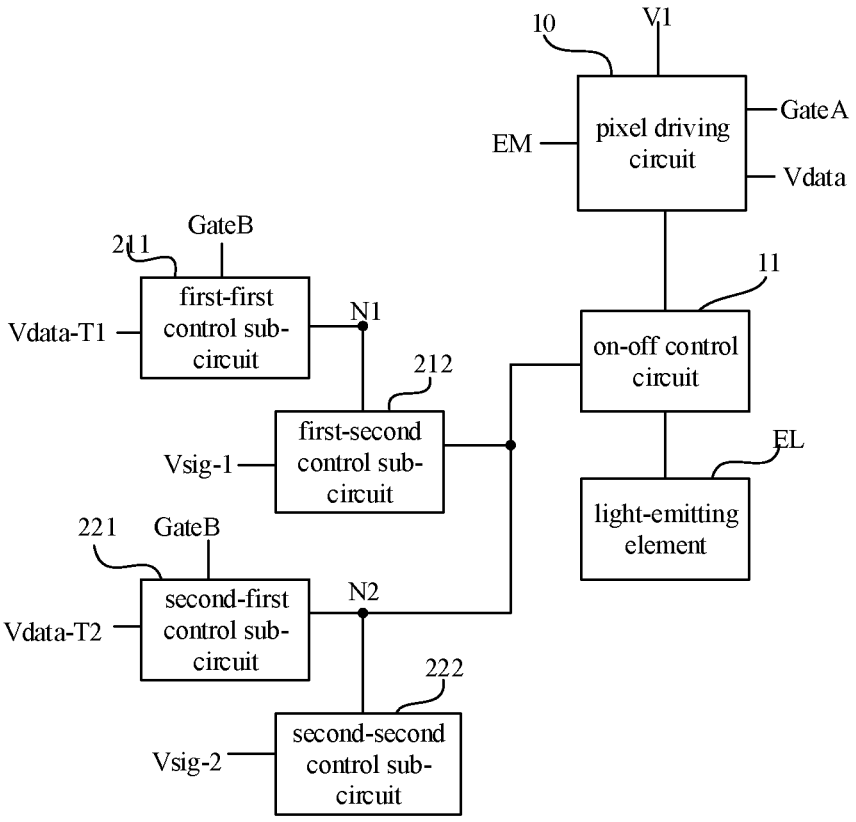
FIG. 3 is another schematic view showing the pixel circuit according to one embodiment of the present disclosure.

As shown in FIG. 3, on the basis of the pixel circuit in FIG. 2, the first light-emission time control sub-circuit includes a first-first control sub-circuit 211 and a first-second control sub-circuit 212.

A control terminal of the first-first control sub-circuit 211 is electrically coupled to the second gate line GateB, and a first terminal of the first-first control sub-circuit 211 is electrically coupled to the first light-emission control data line, a second terminal of the first-first control sub-circuit 211 is electrically coupled to the first control node N1. The first-first control sub-circuit 211 is configured to control the first light-emission control data line to be coupled to, or decoupled from, the first control node N1 under the control of the second gate driving signal and maintain the potential at the first control node N1.

A control terminal of the first-second control sub-circuit 212 is electrically coupled to the first control node N1, and a first terminal of the first-second control sub-circuit 212 is electrically coupled to the first light-emission time control signal output terminal, a second terminal of the first-second control sub-circuit 212 is electrically coupled to the control terminal of the on-off control circuit 11. The first-second control sub-circuit 212 is configured to control the first light-emission time control signal output terminal to be coupled to, or decoupled from, the control terminal of the on-off control circuit 11 under the control of the potential at the first control node N1.

The second light-emission time control sub-circuit includes a second-first control sub-circuit 221 and a second-second control sub-circuit 222.

A control terminal of the second-first control sub-circuit 221 is electrically coupled to the second gate line GateB, and a first terminal of the second-first control sub-circuit 221 is electrically coupled to the second light-emission control data line, a second terminal of the second-first control sub-circuit 221 is electrically coupled to the second control node N2. The second-first control sub-circuit 221 is configured to control the second light-emission control data line to be coupled to, or decoupled from, the second control node N2 under the control of the second gate driving signal and maintain the potential at the second control node N2.

A control terminal of the second-second control sub-circuit 222 is electrically coupled to the second control node N2, and a first terminal of the second-second control sub-circuit 222 is electrically coupled to the second light-emission time control signal output terminal, a second terminal of the second-second control sub-circuit 222 is electrically coupled to the control terminal of the on-off control circuit 11. The second-second control sub-circuit 222 is configured to control the second light-emission time control signal output terminal to be coupled to, or decoupled from, the control terminal of the on-off control circuit 11 under the control of the potential at the second control node N2.

When the pixel circuit shown in FIG. 3 is in operation, in the second charging time period, GateB is turned on, and the first-first control sub-circuit 211 is configured to write Vdata-T1 from the first light-emission control data line into N1 under the control of the second gate driving signal. The first-first control sub-circuit 211 is further configured to maintain the potential at N1 in the second charging time period and the light-emission stage. The second-first control sub-circuit 221 is configured to write Vdata-T2 from the second light-emission control data line into N2 under the control of the second gate driving signal. The second-first control sub-circuit 221 is further configured to maintain the potential at N2 within the second charging time period and the light-emission stage.

In the light-emission stage, the first-second control sub-circuit 212 is configured to control whether the first light-emission time control signal output terminal writes V-sig1 into the control terminal of the on-off control circuit 11 under the control of the potential at N1; and the second-second control sub-circuit 222 is configured to control whether the second light-emission time control signal output terminal writes V-sig2 into the control terminal of the on-off control circuit 11 under the control of the potential at N2.

In the embodiments of present disclosure, N may be equal to 2, and the first-first control sub-circuit may include a first control transistor and a first capacitor, and the first-second control sub-circuit may include a second control transistor.

A control electrode of the first control transistor is electrically coupled to the second gate line, a first electrode of the first control transistor is electrically coupled to the first light-emission control data line, and a second electrode of the first control transistor is electrically coupled to a first control node.

A first terminal of the first capacitor is electrically coupled to the first control node, and a second terminal of the first capacitor is electrically coupled to a second voltage terminal.

A control electrode of the second control transistor is electrically coupled to the first control node, a first electrode of the second control transistor is electrically coupled to a first light-emission time control signal output terminal, and a second electrode of the second control transistor is electrically coupled to the control terminal of the on-off control circuit.

In the embodiments of present disclosure, the second-first control sub-circuit may include a third control transistor and a second capacitor, and the second-second control sub-circuit may include a fourth control transistor.

A control electrode of the third control transistor is electrically coupled to the second gate line, a first electrode of the third control transistor is electrically coupled to a second light-emission control data line, and a second electrode of the third control transistor is electrically coupled to a second control node.

A first terminal of the second capacitor is electrically coupled to the second control node, and a second terminal of the second capacitor is electrically coupled to the second voltage terminal.

A control electrode of the fourth control transistor is electrically coupled to the second control node, a first electrode of the fourth control transistor is electrically coupled to a second light-emission time control signal output terminal, and a second electrode of the fourth control transistor is electrically coupled to the control terminal of the on-off control circuit.

Optionally, the first control transistor and the third control transistor are each a p-type transistor; or, the first control transistor and the third control transistor are each an n-type transistor.

In the embodiment of the present disclosure, the second voltage terminal may be, but not limited to, a low voltage terminal, a ground terminal or a common electrode voltage terminal.

During the implementation, the on-off control circuit may include an on-off control transistor.

A control electrode of the on-off control transistor is the control terminal of the on-off control circuit, a first electrode of the on-off control transistor is electrically coupled to the driving current output terminal, and a second electrode of the on-off control transistor is electrically coupled to the light-emitting element.

Figure 4:
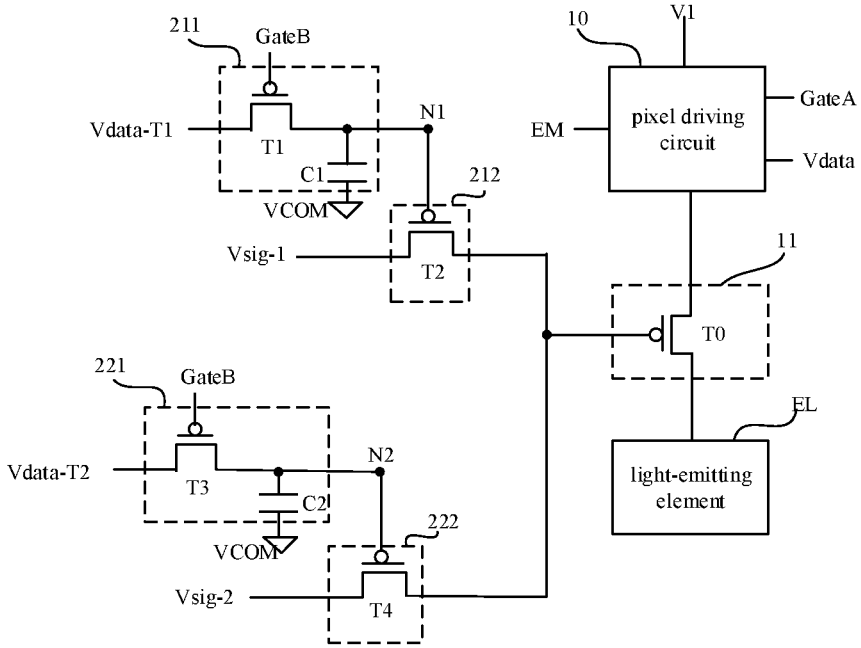
FIG. 4 is another schematic view showing the pixel circuit according to one embodiment of the present disclosure.

As shown in FIG. 4, on the basis of the pixel circuit in FIG. 3, the first-first control sub-circuit 211 may include a first control transistor T1 and a first capacitor C1, the first-second control sub-circuit 212 may include a second control transistor T2, and the on-off control circuit 11 may include an on-off control transistor T0.

A source electrode of T0 is the first terminal of the on-off control circuit 11, and a drain electrode of T0 is the second terminal of the on-off control circuit 11.

A gate electrode of the first control transistor T1 is electrically coupled to the second gate line GateB, a source electrode of the first control transistor T1 is electrically coupled to the first light-emission control data line, and a drain electrode of the first control transistor T1 is electrically coupled to the first control node N1. The first light-emission control data line is configured to apply the first light-emission control data voltage Vdata-T1.

A first terminal of the first capacitor C1 is electrically coupled to the first control node N1, and a second terminal of the first capacitor C1 is electrically coupled to a common electrode voltage terminal. The common electrode voltage terminal is configured to apply a common electrode voltage VCOM.

A gate electrode of the second control transistor T2 is electrically coupled to the first control node N1, a source electrode of the second control transistor T2 is electrically coupled to the first light-emission time control signal output terminal, and a drain electrode of the second control transistor T2 is electrically coupled to a gate electrode of T0. The first light-emission time control signal output terminal is configured to apply the first light-emission time control signal V-sig1.

The second-first control sub-circuit 221 may include a third control transistor T3 and a second capacitor C2, and the second-second control sub-circuit 222 may include a fourth control transistor T4.

A gate electrode of the third control transistor T3 is electrically coupled to the second gate line GateB, a source electrode of the third control transistor T3 is electrically coupled to the second light-emission control data line, and a drain electrode of the third control transistor T3 is electrically coupled to the second control node N2. The second light-emission control data line is configured to apply the second light-emission control data voltage Vdata-T2.

A first terminal of the second capacitor C2 is electrically coupled to the second control node N2, and a second terminal of the second capacitor C2 is electrically coupled to the common electrode voltage terminal. The common electrode voltage terminal is configured to apply the common electrode voltage VCOM.

A gate electrode of the fourth control transistor T4 is electrically coupled to the second control node N2, a source electrode of the fourth control transistor T4 is electrically coupled to the second light-emission time control signal output terminal, and a drain electrode of the fourth control transistor T4 is electrically coupled to the gate electrode of T0. The second light-emission time control signal output terminal is configured to apply the second light-emission time control signal V-sig2.

In FIG. 4, T0, T1, T2, T3, and T4 may each be, but not limited to, a p-type thin film transistor.

In FIG. 4, the second voltage terminal is the common electrode voltage terminal.

When the pixel circuit shown in FIG. 4 is in operation, in the second charging time period of the charging stage, a low-voltage signal may be applied to GateB to turn on T1 and T3, Vdata_T1 is written into N1, the potential at N1 is maintained by C1, Vdata_T2 is written into N2, and the potential at N2 is maintained by C2. A low-voltage signal may be applied to Vdata_T1 or Vdata_T2.

Figure 5A:
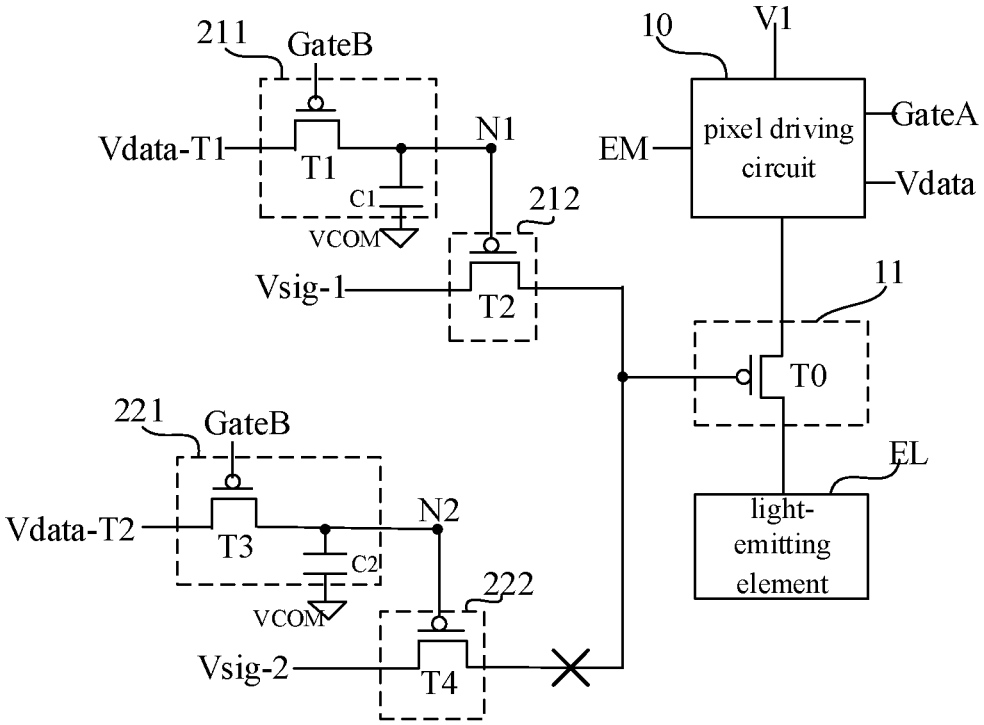
FIG. 5A is a schematic view showing an operating state of the pixel circuit according to one embodiment of the present disclosure.
Figure 5B:
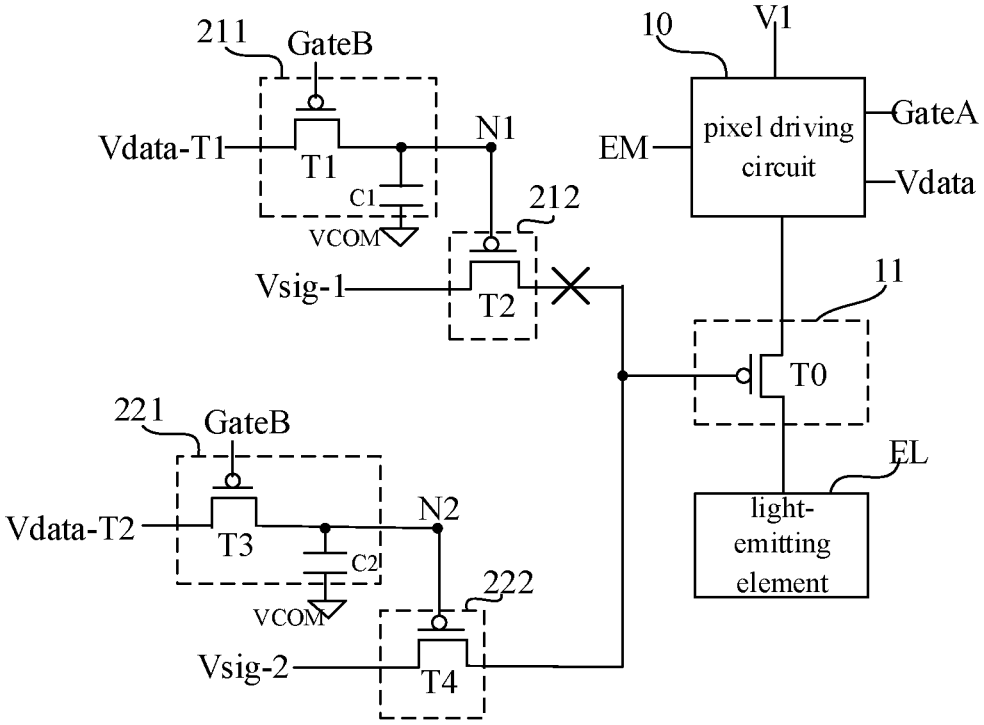
FIG. 5B is a schematic view showing another operating state of the pixel circuit according to one embodiment of the present disclosure.

In the light-emission stage, a high-voltage signal may be applied to GateB to turn off T1 and T3. When a low-voltage signal is applied to Vdata_T1 in the second charging time period, as shown in FIG. 5A, in the light-emission stage, T2 is turned on, T4 is turned off, and V-sig1 is written into the control terminal of the on-off control circuit 11, so as to control a duration when the on-off control circuit 11 is in an on state, thereby controlling the duration when the light-emitting element emits light. When a low-voltage signal is applied to Vdata_T2 in the second charging time period, as shown in FIG. 5B, T4 is turned on, T2 is turned off, and V-sig2 is written into the control terminal of the on-off control circuit 11, so as to control the duration when the on-off control circuit 11 is in an on state, thereby controlling the duration when the light-emitting element emits light.

During the implementation, V-sig1 and V-sig2 may be pulse signals of different duty ratios. When T2 or T4 is turned on, it means that the entire pixel circuit may operate in different pulse widths, thereby realizing the division of grayscales.

According to another specific embodiment, N is equal to 2, and a first light-emission control data line and a second light-emission control data line are a same light-emission control data line. The light-emission time control circuit includes a fifth control transistor, a sixth control transistor, a seventh control transistor and a third capacitor.

A control electrode of the fifth control transistor is electrically coupled to the second gate line, a first electrode of the fifth control transistor is electrically coupled to the first light-emission control data line, and a second electrode of the fifth control transistor is electrically coupled to a control electrode of the sixth control transistor and a control electrode of the seventh control transistor.

A first terminal of the third capacitor is electrically coupled to the control electrode of the sixth control transistor, and a second terminal of the third capacitor is electrically coupled to a second voltage terminal V2.

A first electrode of the sixth control transistor is electrically coupled to a first light-emission time control signal output terminal, and a second electrode of the sixth control transistor is electrically coupled to the control terminal of the on-off control circuit.

A first electrode of the seventh control transistor is electrically coupled to a second light-emission time control signal output terminal, and a second electrode of the seventh control transistor is electrically coupled to the control terminal of the on-off control circuit.

Optionally, the sixth control transistor is an n-type transistor, and the seventh control transistor is a p-type transistor; or, the sixth control transistor is a p-type transistor, and the seventh control transistor is an n-type transistor.

During the implementation, in the case that N is equal to 2, the first light-emission control data line and the second light-emission control data line may be the same light-emission control data line. At this time, the light-emission time control circuit may merely include three transistors.

Figure 6:
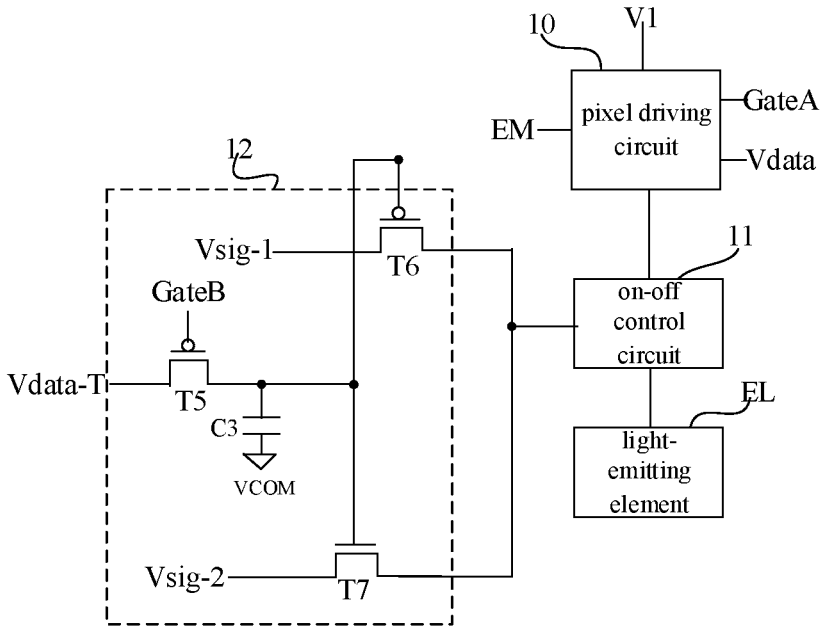
FIG. 6 is another schematic view showing the pixel circuit according to one embodiment of the present disclosure.

As shown in FIG. 6, on the basis of the pixel circuit in FIG. 1, N is equal to 2, and the first light-emission control data line and the second light-emission control data line are the same light-emission control data line. The first light-emission control data line is configured to apply a light-emission control data voltage Vdata-T.

The light-emission time control circuit 12 includes a fifth control transistor T5, a sixth control transistor T6, a seventh control transistor T7 and a third capacitor C3.

A gate electrode of the fifth control transistor T5 is electrically coupled to the second gate line GateB, a source electrode of the fifth control transistor T5 is electrically coupled to the first light-emission control data line, and a drain electrode of the fifth control transistor T5 is electrically coupled to a gate electrode of the sixth control transistor T6 and a gate electrode of the seventh control transistor T7.

A first terminal of the third capacitor C3 is electrically coupled to the gate electrode of the sixth control transistor T6, and a second terminal of the third capacitor C3 is electrically coupled to a common electrode voltage terminal. The common electrode voltage terminal is configured to apply a common electrode voltage VCOM.

A source electrode of the sixth control transistor T6 is electrically coupled to the first light-emission time control signal output terminal, and a drain electrode of the sixth control transistor T6 is electrically coupled to the control terminal of the on-off control circuit 11. The first light-emission time control signal output terminal is configured to apply the first light-emission time control signal V-sig1.

A source electrode of the seventh control transistor T7 is electrically coupled to a second light-emission time control signal output terminal, and a drain electrode of the seventh control transistor T7 is electrically coupled to the control terminal of the on-off control circuit 11. The second light-emission time control signal output terminal is configured to apply the second light-emission time control signal V-sig2.

In FIGS. 6, T5 and T6 may each be, but not limited to, a p-type thin film transistor, and T7 may be, but not limited to, an n-type thin film transistor.

In FIG. 6, the second voltage terminal is the common electrode voltage terminal.

When the pixel circuit in FIG. 6 is in operation, in the second charging time period of the charging stage, a low-voltage signal may be applied to GateB to turn on T5, Vdata_T is written into the gate electrode of T6 and the gate electrode of T7, and Vdata-T is stored in C3.

At the light-emission stage, a high-voltage signal may be applied to GateB to turn off T5. When Vdata-T is a low-voltage signal in the second charging time period, in the light-emission stage, T6 is turned on, T7 is turned off, and V-sig1 is written into the control terminal of the on-off control circuit 11. When a high-voltage signal is applied to Vdata_T in the second charging time period, in the light-emission stage, T7 is turned on, T6 is turned off, and V-sig2 is written into the control terminal of the on-off control circuit 11.

Figure 7:
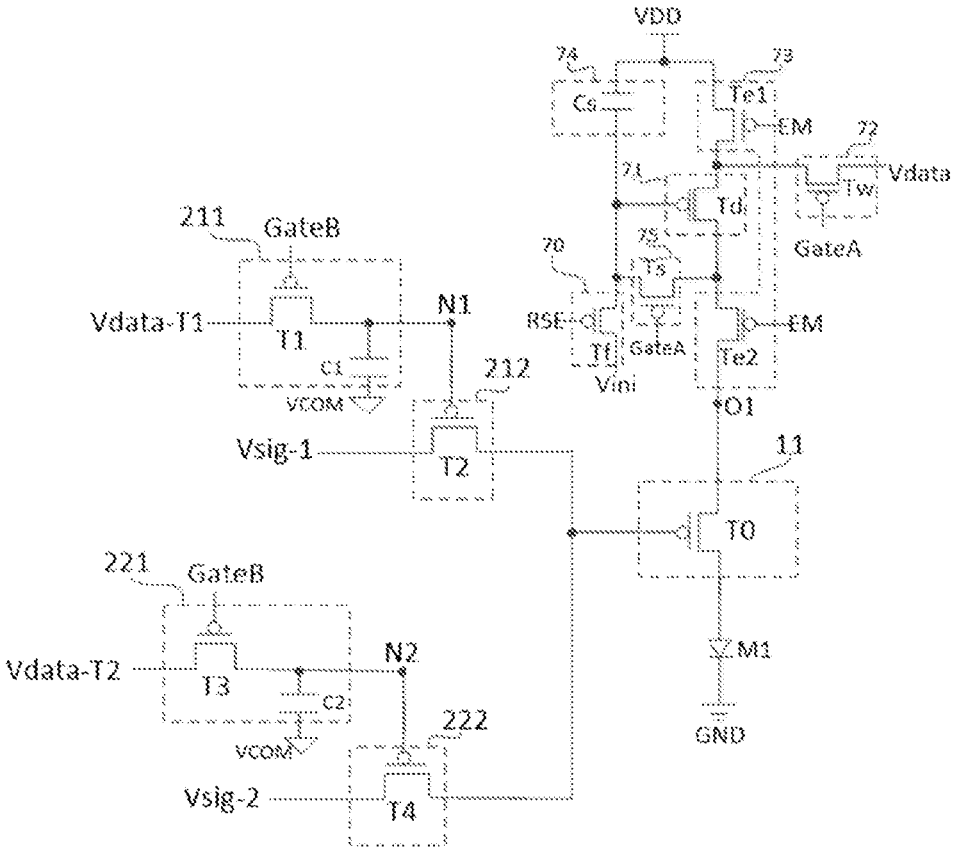
FIG. 7 is a circuit diagram of the pixel circuit according to one embodiment of the present disclosure.

In the embodiment of the present disclosure, as shown in FIG. 7, the light-emitting element is a micro light-emitting diode M1. The pixel driving circuit may include a driving sub-circuit 71, a data written-in sub-circuit 72, a light-emission control sub-circuit 73, an energy storage sub-circuit 74 and a compensation sub-circuit 75.

The second terminal of the on-off control circuit 11 is electrically coupled to an anode of M1, and a cathode of M1 is electrically coupled to a ground terminal GND.

The data written-in sub-circuit 72 is electrically coupled to the first gate line GateA, the display data line and the first terminal of the driving sub-circuit 71, and configured to write the display data voltage Vdata from the display data line into the first terminal of the driving sub-circuit 71 under the control of the first gate driving signal.

The compensation sub-circuit 75 is electrically coupled to the first gate line GateA, a control terminal of the driving sub-circuit 71 and a second terminal of the driving sub-circuit 71, and configured to control the control terminal of the driving sub-circuit 71 to be coupled to, or decoupled from, the second terminal of the driving sub-circuit 71 under the control of the first gate driving signal.

A first terminal of the energy storage sub-circuit 74 is electrically coupled to the control terminal of the driving sub-circuit 71, a second terminal of the energy storage sub-circuit 74 is electrically coupled to the first voltage terminal V1, and the energy storage sub-circuit 74 is configured to maintain a potential at the control terminal of the driving sub-circuit 71.

The light-emission control sub-circuit 73 is electrically coupled to the light-emission control line EM, the first voltage terminal V1, the first terminal of the driving sub-circuit 71, the second terminal of the driving sub-circuit 71 and the first terminal of the on-off control circuit 11, and configured to control the first voltage terminal B1 to be coupled to, or decoupled from, the first terminal of the driving sub-circuit 71 and control the second terminal of the driving sub-circuit 71 to be coupled to, or decoupled from, the first terminal of the on-off control circuit 11 under the control of the light-emission control line EM.

The driving sub-circuit 71 is configured to generate the driving current under the control of the potential at the control terminal of the driving sub-circuit.

When the pixel circuit shown in FIG. 7 is in operation, in the first charging time period of the charging stage, the first gate driving signal from GateA controls the data written-in sub-circuit 72 to write Vdata into the first terminal of the driving sub-circuit 71 and controls the compensation sub-circuit 75 to control the control terminal of the driving sub-circuit 71 to be coupled to the second terminal of the driving sub-circuit 71, so as to compensate a threshold voltage of the driving transistor included in the driving sub-circuit 71. A light-emission control signal is applied to EM, so as to control the first voltage terminal B1 to be decoupled from the first terminal of the driving sub-circuit 71, and control the second terminal of the driving sub-circuit 71 to be decoupled from the first terminal of the on-off control circuit 11. The energy storage sub-circuit 74 maintains the potential at the control terminal of the driving sub-circuit 71.

In the light-emission time period, the first gate driving signal from GateA controls the data written-in sub-circuit 72 to stop writing Vdata into the first terminal of the driving sub-circuit 71 and controls the compensation sub-circuit 75 to control the control terminal of the driving sub-circuit 71 to be decoupled from the second terminal of the driving sub-circuit 71. A light-emission control signal is applied to EM, so as to control the first voltage terminal B1 to be coupled to the first terminal of the driving sub-circuit 71, and control the second terminal of the driving sub-circuit 71 to be coupled to the first terminal of the on-off control circuit 11. The driving sub-circuit 71 generates a driving current according to Vdata. When the on-off control circuit 11 couples the first terminal of the on-off control circuit 11 to the anode of M1 under the control of the potential at the control terminal of the on-off control circuit 11, M1 emits light, and the duration when M1 emits light determines the display brightness and display grayscale.

During the implementation, as shown in FIG. 7, the pixel driving circuit may further include a resetting sub-circuit 70.

The resetting sub-circuit 70 is electrically coupled to a resetting control terminal RSE, an initial voltage terminal and the control terminal of the driving sub-circuit 71, and configured to write an initial voltage Vini at the initial voltage terminal into the control terminal of the driving sub-circuit 71 under the control of a resetting control signal from the resetting control terminal RSE.

When the pixel circuit shown in FIG. 7 is in operation, a resetting stage is arranged before the charging stage.

In the resetting stage, the resetting sub-circuit 70 writes the initial voltage Vini from the initial voltage terminal into the control terminal of the driving sub-circuit 71 under the control of the resetting control signal from the resetting control terminal RSE, so as to write Vini into the energy storage sub-circuit 74, thereby to ensure that Vdata may be written normally.

Optionally, the data written-in sub-circuit includes a data written-in transistor, the compensation sub-circuit includes a compensation transistor, and the light-emission control sub-circuit includes a first light-emission control transistor and a second light-emission control transistor, the driving sub-circuit includes a driving transistor, the energy storage sub-circuit includes a storage capacitor, and the resetting sub-circuit includes a resetting transistor.

A control electrode of the data written-in transistor is electrically coupled to the first gate line, a first electrode of the data written-in transistor is electrically coupled to the display data line, and a second electrode of the data written-in transistor is electrically coupled to a first electrode of the driving transistor.

A control electrode of the compensation transistor is electrically coupled to the first gate line, a first electrode of the compensation transistor is electrically coupled to a control electrode of the driving transistor, and a second electrode of the compensation transistor is electrically coupled to a second electrode of the driving transistor.

A control electrode of the first light-emission control transistor is electrically coupled to the light-emission control line, a first electrode of the first light-emission control transistor is electrically coupled to the first voltage terminal, and a second electrode of the first light-emission control transistor is electrically coupled to the first electrode of the driving transistor.

A control electrode of the second light-emission control transistor is electrically coupled to the light-emission control line, a first electrode of the second light-emission control transistor is electrically coupled to the second electrode of the driving transistor, and a second electrode of the second light-emission control transistor is electrically coupled to the first terminal of the on-off control circuit.

A first terminal of the storage capacitor is electrically coupled to the first voltage terminal, and a second terminal of the storage capacitor is electrically coupled to the control electrode of the driving transistor. A control electrode of the resetting transistor is electrically coupled to the resetting control terminal, a first electrode of the resetting transistor is electrically coupled to the initial voltage terminal, and a second electrode of the resetting transistor is electrically coupled to the control electrode of the driving transistor.

In the embodiment of the present disclosure, the light-emitting element is a micro light-emitting diode, the second terminal of the on-off control circuit is electrically coupled to an anode of the micro light-emitting diode, and a cathode of the micro light-emitting diode is electrically coupled to a third voltage terminal. However, the present disclosure shall not be limited thereto.

In the embodiment of the present disclosure, the third voltage terminal may be, but not limited to, a low voltage terminal or a ground terminal.

As shown in FIG. 7, the on-off control circuit 11 may include the on-off control transistor T0.

The data written-in sub-circuit 72 may include a data written-in transistor Tw, the compensation sub-circuit 75 may include a compensation transistor Ts, and the light-emission control sub-circuit 73 may include a first light-emission control transistor Te1 and a second light-emission control transistor Te2, the driving sub-circuit 71 may include a driving transistor Td, the energy storage sub-circuit 74 may include a storage capacitor Cs, and the resetting sub-circuit 70 may include a resetting transistor Tf.

A gate electrode of the data written-in transistor Tw is electrically coupled to the first gate line GateA, a source electrode of the data written-in transistor Tw is electrically coupled to the display data line, and a drain electrode of the data written-in transistor Tw is electrically coupled to a source electrode of the driving transistor Td.

A gate electrode of the compensation transistor Ts is electrically coupled to the first gate line GateA, a source electrode of the compensation transistor Ts is electrically coupled to a gate electrode of the driving transistor Td, and a drain electrode of the compensation transistor Ts is electrically coupled to a drain electrode of the driving transistor Td.

A gate electrode of the first light-emission control transistor Te1 is electrically coupled to the light-emission control line EM, a source electrode of the first light-emission control transistor Te1 is electrically coupled to a high voltage terminal, and a drain electrode of the first light-emission control transistor Te1 is electrically coupled to the source electrode of the driving transistor Td. The high voltage terminal is configured to apply a high voltage VDD.

A gate electrode of the second light-emission control transistor Te2 is electrically coupled to the light-emission control line EM, a source electrode of the second light-emission control transistor Te2 is electrically coupled to the drain electrode of the driving transistor Td, and a drain electrode of the second light-emission control transistor Te2 is electrically coupled to the source electrode of the on-off control transistor T0.

A first terminal of the storage capacitor Cs is electrically coupled to the high voltage terminal, and a second terminal of the storage capacitor Cs is electrically coupled to the gate electrode of the driving transistor Td.

A gate electrode of the resetting transistor Tf is electrically coupled to the resetting control terminal RSE, a source electrode of the resetting transistor Tf is electrically coupled to the initial voltage terminal, and a drain electrode of the resetting transistor Tf is electrically coupled to the gate electrode of the driving transistor Td.

A structure of the light-emission time control circuit 12 is as shown in FIG. 4.

In FIG. 7, O1 denotes the driving current output terminal.

In the pixel circuit shown in FIG. 7, each transistor may be, but not limited to, a p-type thin film transistor.

Figure 8:
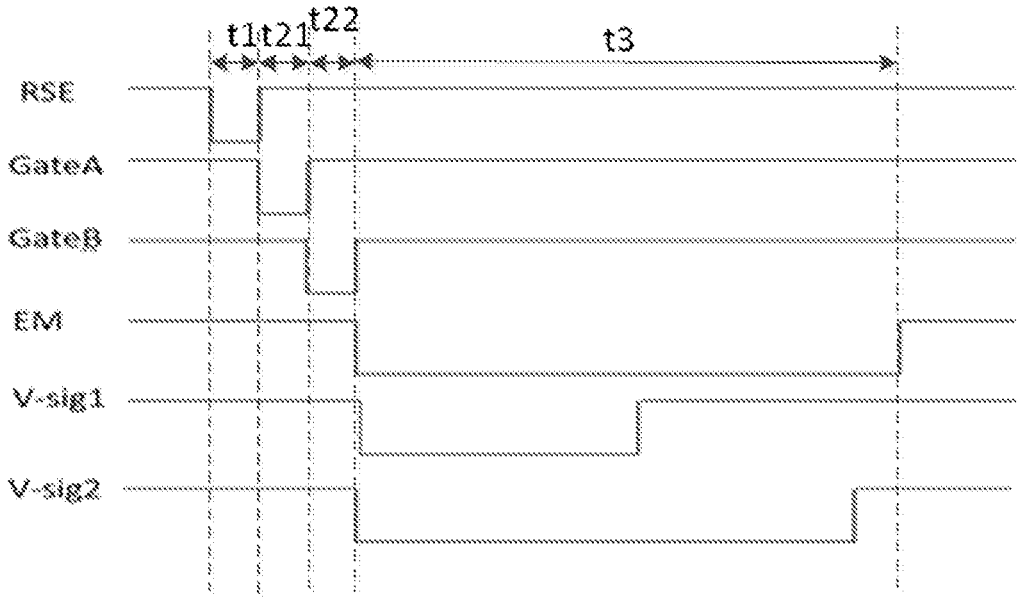
FIG. 8 is a timing sequence diagram of the pixel circuit in FIG. 7.

As shown in FIG. 8, when the pixel circuit shown in FIG. 7 is in operation, the display period includes a resetting stage t1, a charging stage and a light-emission stage t3 arranged one after another.

In the resetting stage t1, a low-voltage signal is applied to RSE to turn on Tf, so as to write Vini into the gate electrode of Td. A high-voltage signal is applied to each of GateA, GateB and EM.

In a first charging time period t21 of the charging stage, a high-voltage signal is applied to RSE, a low-voltage signal is applied to GateA, and a high-voltage signal is applied to each of GateB and EM. Both Tw and Ts are turned on to write Vdata into the source electrode of Td. An initial potential at the gate electrode of Td is Vini, and Td is turned on, so as to charge Cs by Vdata through Td and Ts until a potential at the gate electrode of Td becomes Vdata+Vth. Then Td is turned off, and the potential at the gate electrode of Td may be maintained as Vdata+Vth. In t21, both Te1 and Te2 are turned off.

In a second charging time period t22 of the charging stage, a high-voltage signal is applied to RSE, a high-voltage signal is applied to GateA, a high-voltage signal is applied to EM, and a low-voltage signal is applied to GateB. Both T1 and T3 are turned on to write Vdata-T1 into N1 and write Vdata-T2 into N2. The potential at N1 may be maintained by C1, and the potential at N2 may be maintained by C2. At this time, V-sig1 and V-sig2 may each be a high-voltage signal, so as to control T0 to be turned off.

In the light-emission stage t3, a high-voltage signal is applied to each of RSE, GateA and GateB, and a low-voltage signal is applied to EM, so as to turn on Te1 and Te2. Td is turned on. When T0 is turned on, Td may drive M1 to emit light. Whether T0 is turned on or off is determined by a voltage signal applied to T0. In t22, when Vdata-T1 is a low-voltage signal and Vdata-T2 is a high-voltage signal, V-sig1 is applied to the gate electrode of T0. As shown in FIG. 8, during a first half time period of t3, V-sig1 is a low-voltage signal, T0 is turned on, and Td drives M1 to emit light. During a second half time period of t3, V-sig1 is a high-voltage signal, T0 is turned off, and M1 does not emit light. In t22, when Vdata-T1 is a high-voltage signal, Vdata-T2 is a low-voltage signal, V-sig2 is applied to the gate electrode of T0. As shown in FIG. 8, in the light-emission stage t3, a duration when V-sig2 is a low-voltage signal is relatively long. Therefore, under the control of V-sig2, a luminous brightness value of M1 is larger.

In the pixel circuit of the embodiment of the present disclosure, different pulse signals may be written in one display period, Vdata-T1 and Vdata-T2 may be applied at the same time, and V-sig1 and V-sig2 may be applied at the same time. Thus, it is able to solve the problem that the light-emission time control needs to be finished in multiple time periods, save the time, and be suitable for the display of the high-resolution Micro LED.

Figure 10:
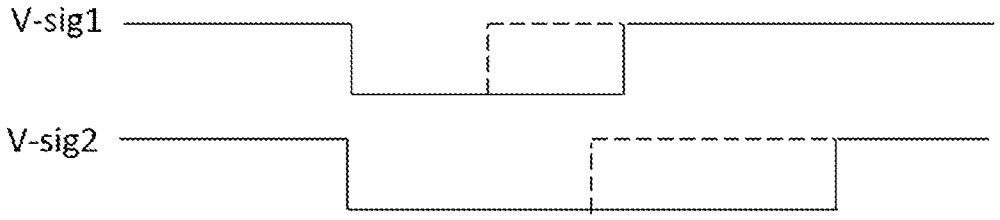
FIG. 10 is a schematic diagram of a light-emission time control signal in the pixel circuit of the present disclosure.

When the overall brightness of the display panel is adjusted through the pixel circuit in the embodiment of the present disclosure, it only requires to multiply by a percentage of an overall brightness value of the display panel on the basis of an original pulse width of a pulse signal. For example, for a display panel where 50% of the overall brightness value is required, as shown in FIG. 10, each of pulse widths of V-sig1 and V-sig2 is changed from 100% to 50%.

Figure 9:
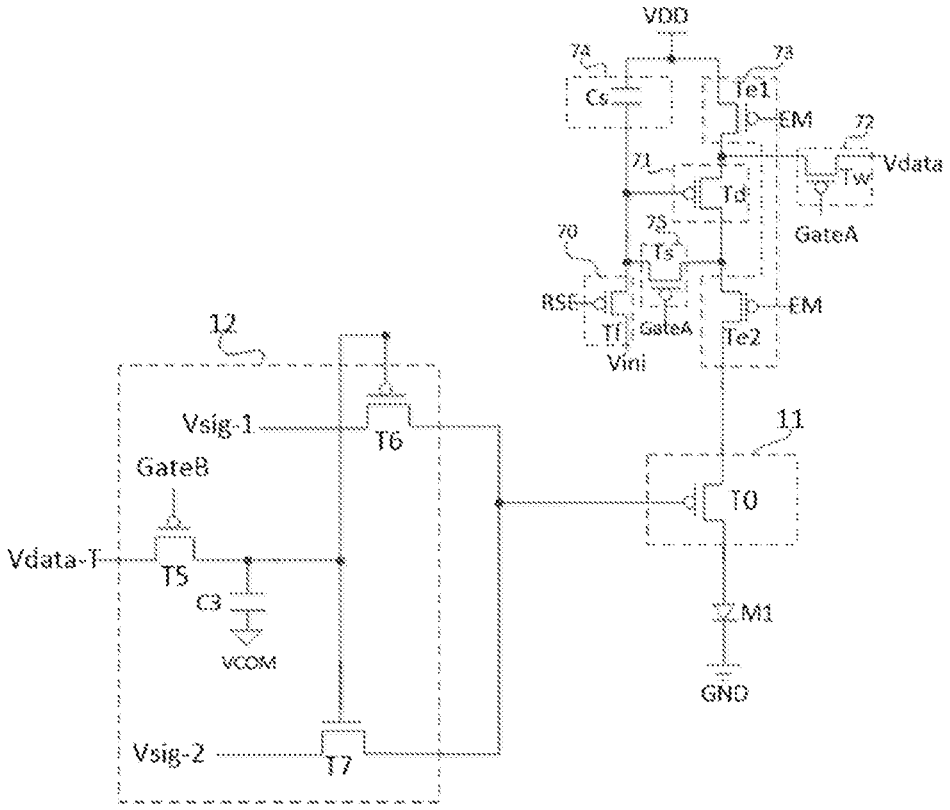
FIG. 9 is another circuit diagram of the pixel circuit according to one embodiment of the present disclosure.

A difference between the pixel circuit in FIG. 9 and the pixel circuit in FIG. 7 is that the light-emission time control circuit 12 in FIG. 9 is of the structure shown in FIG. 6.

A pixel driving method for driving the above-mentioned pixel circuit includes: applying, by the pixel driving circuit, a driving current for driving the light-emitting element to emit light through the driving current output terminal in accordance with a display data voltage under the control of a first gate driving signal and a light-emission control signal; controlling, by the on-off control circuit, the driving current output terminal to be coupled to, or decoupled from, the light-emitting element under the control of a potential at the control terminal of the on-off control circuit; and controlling, by the light-emission time control circuit, the $n^{th}$ light-emission time control signal output terminal to be coupled to, or decoupled from, the control terminal of the on-off control circuit in accordance with an $n^{th}$ light-emission control data voltage under the control of a second gate driving signal; where n is a positive integer smaller than or equal to N, and N is an integer larger than 1.

At least two light-emission time control signals (the light-emission time control signal may be, but not limited to, a pulse signal that controls the on-off control circuit to control the driving current output terminal to be coupled or decoupled from the light-emitting element) may be applied at the same time in the pixel circuit of embodiment of the present disclosure. Therefore, it is able to solve the problem that the light-emission time control needs to be finished in multiple time periods, save the time, and be suitable for the display of the high-resolution Micro LED.

A display device including the above-mentioned pixel circuit is further provided in the embodiment of the present disclosure.

The display device may be any product or member having a display function, e.g., a mobile phone, a flat-panel computer, a television, a display, a laptop computer, a digital photo frame or a navigator.

The above embodiments are for illustrative purposes only, but the present disclosure is not limited thereto. Obviously, a person skilled in the art may make further modifications and improvements without departing from the principle of the present disclosure, and these modifications and improvements shall also fall within the scope of the present disclosure.

The invention claimed is:

1. A pixel circuit, comprising: a light-emitting element, a pixel driving circuit, an on-off control circuit and a light-emission time control circuit;

wherein the pixel driving circuit is electrically coupled to a first gate line, a display data line, a light-emission control line, a first voltage terminal and the on-off control circuit, and configured to apply a driving current through a driving current output terminal in accordance with a display data voltage from the display data line under control of a first gate driving signal from the first gate line and a light-emission control signal from the light-emission control line;

a control terminal of the on-off control circuit is electrically coupled to the light-emission time control circuit, a first terminal of the on-off control circuit is electrically coupled to the driving current output terminal, a second terminal of the on-off control circuit is electrically coupled to the light-emitting element, and the on-off control circuit is configured to control the driving current output terminal to be coupled to, or decoupled from, the light-emitting element under control of a potential at the control terminal of the on-off control circuit; and the light-emission time control circuit is electrically coupled to a second gate line, light-emission control data lines, N light-emission time control signal output terminals and the control terminal of the on-off control circuit, and configured to control an $n^{th}$ light-emission time control signal output terminal to be coupled to, or decoupled from, the control terminal of the on-off control circuit in accordance with an $n^{th}$ light-emission control data voltage from an $n^{th}$ light-emission control data line under control of a second gate driving signal from the second gate line; wherein the $n^{th}$ light-emission time control signal output terminal is configured to apply an $n^{th}$ light-emission time control signal, N is an integer larger than 1, and n is a positive integer smaller than or equal to N.

2. The pixel circuit according to claim 1, wherein the light-emission time control circuit comprises N light-emission time control sub-circuits, an $n^{th}$ light-emission time control sub-circuit is electrically coupled to the second gate line, the $n^{th}$ light-emission control data line, the $n^{th}$ light-emission time control signal output terminal and the control terminal of the on-off control circuit, and configured to write the $n^{th}$ light-emission control data voltage into an $n^{th}$ control node under control of the second gate driving signal from the second gate line, maintain a potential at the $n^{th}$ control node, and control the $n^{th}$ light-emission time control signal output terminal to be coupled to, or decoupled from, the control terminal of the on-off control circuit under control of the potential at the $n^{th}$ control node.

3. The pixel circuit according to claim 2, wherein the $n^{th}$ light-emission time control sub-circuit comprises an $n^{th}$ first control sub-circuit and an $n^{th}$ second control sub-circuit;

a control terminal of the $n^{th}$ first control sub-circuit is electrically coupled to the second gate line, and a first terminal of the $n^{th}$ first control sub-circuit is electrically coupled to the $n^{th}$ light-emission control data line, a second terminal of the $n^{th}$ first control sub-circuit is electrically coupled to the $n^{th}$ control node, and the $n^{th}$ first control sub-circuit is configured to control the $n^{th}$ light-emission control data line to be coupled to, or decoupled from, the $n^{th}$ control node under control of the second gate driving signal and maintain the potential at the $n^{th}$ control node;

a control terminal of the $n^{th}$ second control sub-circuit is electrically coupled to the $n^{th}$ control node, and a first terminal of the $n^{th}$ second control sub-circuit is electrically coupled to the $n^{th}$ light-emission time control signal output terminal, a second terminal of the $n^{th}$ second control sub-circuit is electrically coupled to the control terminal of the on-off control circuit, and the $n^{th}$ second control sub-circuit is configured to control the $n^{th}$ light-emission time control signal output terminal to be coupled to, or decoupled from, the control terminal of the on-off control circuit under control of the potential at the $n^{th}$ control node.

4. The pixel circuit according to claim 3, wherein

N is equal to 2, a first-first control sub-circuit comprises a first control transistor and a first capacitor, and a first-second control sub-circuit comprises a second control transistor;

a control electrode of the first control transistor is electrically coupled to the second gate line, a first electrode of the first control transistor is electrically coupled to a first light-emission control data line, and a second electrode of the first control transistor is electrically coupled to a first control node;

a first terminal of the first capacitor is electrically coupled to the first control node, and a second terminal of the first capacitor is electrically coupled to a second voltage terminal; and a control electrode of the second control transistor is electrically coupled to the first control node, a first electrode of the second control transistor is electrically coupled to a first light-emission time control signal output terminal, and a second electrode of the second control transistor is electrically coupled to the control terminal of the on-off control circuit.

5. The pixel circuit according to claim 4, wherein a second-first control sub-circuit comprises a third control transistor and a second capacitor, and a second-second control sub-circuit comprises a fourth control transistor;

a control electrode of the third control transistor is electrically coupled to the second gate line, a first electrode of the third control transistor is electrically coupled to a second light-emission control data line, and a second electrode of the third control transistor is electrically coupled to a second control node;

a first terminal of the second capacitor is electrically coupled to the second control node, and a second terminal of the second capacitor is electrically coupled to the second voltage terminal; and a control electrode of the fourth control transistor is electrically coupled to the second control node, a first electrode of the fourth control transistor is electrically coupled to a second light-emission time control signal output terminal, and a second electrode of the fourth control transistor is electrically coupled to the control terminal of the on-off control circuit.

6. The pixel circuit according to claim 5, wherein the first control transistor and the third control transistor are each a p-type transistor; or, the first control transistor and the third control transistor are each an n-type transistor.

7. The pixel circuit according to claim 1, wherein N is equal to 2, and a first light-emission control data line and a second light-emission control data line are a same light-emission control data line;

the light-emission time control circuit comprises a fifth control transistor, a sixth control transistor, a seventh control transistor and a third capacitor;

a control electrode of the fifth control transistor is electrically coupled to the second gate line, a first electrode of the fifth control transistor is electrically coupled to the first light-emission control data line, and a second electrode of the fifth control transistor is electrically coupled to a control electrode of the sixth control transistor and a control electrode of the seventh control transistor;

a first terminal of the third capacitor is electrically coupled to the control electrode of the sixth control transistor, and a second terminal of the third capacitor is electrically coupled to a second voltage terminal;

a first electrode of the sixth control transistor is electrically coupled to a first light-emission time control signal output terminal, and a second electrode of the sixth control transistor is electrically coupled to the control terminal of the on-off control circuit; and a first electrode of the seventh control transistor is electrically coupled to a second light-emission time control signal output terminal, and a second electrode of the seventh control transistor is electrically coupled to the control terminal of the on-off control circuit.

8. The pixel circuit according to claim 7, wherein the sixth control transistor is an n-type transistor, and the seventh control transistor is a p-type transistor; or, the sixth control transistor is a p-type transistor, and the seventh control transistor is an n-type transistor.

9. The pixel circuit according to claim 1, wherein the on-off control circuit comprises an on-off control transistor; a control electrode of the on-off control transistor is the control terminal of the on-off control circuit, a first electrode of the on-off control transistor is electrically coupled to the driving current output terminal, and a second electrode of the on-off control transistor is electrically coupled to the light-emitting element.

10. The pixel circuit according to claim 1, wherein the pixel driving circuit comprises a driving sub-circuit, a data written-in sub-circuit, a light-emission control sub-circuit, an energy storage sub-circuit and a compensation sub-circuit, wherein the data written-in sub-circuit is electrically coupled to the first gate line, the display data line and a first terminal of the driving sub-circuit, and configured to write the display data voltage into the first terminal of the driving sub-circuit under control of the first gate driving signal;

the compensation sub-circuit is electrically coupled to the first gate line, a control terminal of the driving sub-circuit and a second terminal of the driving sub-circuit, and configured to control the control terminal of the driving sub-circuit to be coupled to, or decoupled from, the second terminal of the driving sub-circuit under control of the first gate driving signal;

a first terminal of the energy storage sub-circuit is electrically coupled to the control terminal of the driving sub-circuit, a second terminal of the energy storage sub-circuit is electrically coupled to the first voltage terminal, and the energy storage sub-circuit is configured to maintain a potential at the control terminal of the driving sub-circuit;

the light-emission control sub-circuit is electrically coupled to the light-emission control line, the first voltage terminal, the first terminal of the driving sub-circuit, the second terminal of the driving sub-circuit and the first terminal of the on-off control circuit, and configured to control the first voltage terminal to be coupled to, or decoupled from, the first terminal of the driving sub-circuit and control the second terminal of the driving sub-circuit to be coupled to, or decoupled from, the first terminal of the on-off control circuit under control of the light-emission control line; and the driving sub-circuit is configured to generate the driving current under control of the potential at the control terminal of the driving sub-circuit.

11. The pixel circuit according to claim 10, wherein the pixel driving circuit further comprises a resetting sub-circuit;

the resetting sub-circuit is electrically coupled to a resetting control terminal, an initial voltage terminal and the control terminal of the driving sub-circuit, and configured to write an initial voltage from the initial voltage terminal into the control terminal of the driving sub-circuit under control of a resetting control signal from the resetting control terminal.

12. The pixel circuit according to claim 11, wherein the data written-in sub-circuit comprises a data written-in transistor, the compensation sub-circuit comprises a compensation transistor, and the light-emission control sub-circuit comprises a first light-emission control transistor and a second light-emission control transistor, the driving sub-circuit comprises a driving transistor, the energy storage sub-circuit comprises a storage capacitor, and the resetting sub-circuit comprises a resetting transistor;

a control electrode of the data written-in transistor is electrically coupled to the first gate line, a first electrode of the data written-in transistor is electrically coupled to the display data line, and a second electrode of the data written-in transistor is electrically coupled to a first electrode of the driving transistor;

a control electrode of the compensation transistor is electrically coupled to the first gate line, a first electrode of the compensation transistor is electrically coupled to a control electrode of the driving transistor, and a second electrode of the compensation transistor is electrically coupled to a second electrode of the driving transistor;

a control electrode of the first light-emission control transistor is electrically coupled to the light-emission control line, a first electrode of the first light-emission control transistor is electrically coupled to the first voltage terminal, and a second electrode of the first light-emission control transistor is electrically coupled to the first electrode of the driving transistor;

a control electrode of the second light-emission control transistor is electrically coupled to the light-emission control line, a first electrode of the second light-emission control transistor is electrically coupled to the second electrode of the driving transistor, and a second electrode of the second light-emission control transistor is electrically coupled to the first terminal of the on-off control circuit;

a first terminal of the storage capacitor is electrically coupled to the first voltage terminal, and a second terminal of the storage capacitor is electrically coupled to the control electrode of the driving transistor; and a control electrode of the resetting transistor is electrically coupled to the resetting control terminal, a first electrode of the resetting transistor is electrically coupled to the initial voltage terminal, and a second electrode of the resetting transistor is electrically coupled to the control electrode of the driving transistor.

13. The pixel circuit according to claim 1, wherein the light-emitting element is a micro light-emitting diode, the second terminal of the on-off control circuit is electrically coupled to an anode of the micro light-emitting diode, and a cathode of the micro light-emitting diode is electrically coupled to a third voltage terminal.

14. A pixel driving method for driving the pixel circuit according to claim 1, comprising:

applying, by the pixel driving circuit, a driving current for driving the light-emitting element to emit light through the driving current output terminal in accordance with a display data voltage under control of a first gate driving signal and a light-emission control signal;

controlling, by the on-off control circuit, the driving current output terminal to be coupled to, or decoupled from, the light-emitting element under control of a potential at the control terminal of the on-off control circuit; and controlling, by the light-emission time control circuit, the $n^{th}$ light-emission time control signal output terminal to be coupled to, or decoupled from, the control terminal of the on-off control circuit in accordance with an $n^{th}$ light-emission control data voltage under control of a second gate driving signal;

wherein n is a positive integer smaller than or equal to N, and N is an integer larger than 1.

15. A display device, comprising: a pixel circuit, wherein the pixel circuit comprises a light-emitting element, a pixel driving circuit, an on-off control circuit and a light-emission time control circuit;

wherein the pixel driving circuit is electrically coupled to a first gate line, a display data line, a light-emission control line, a first voltage terminal and the on-off control circuit, and configured to apply a driving current through a driving current output terminal in accordance with a display data voltage from the display data line under control of a first gate driving signal from the first gate line and a light-emission control signal from the light-emission control line;

a control terminal of the on-off control circuit is electrically coupled to the light-emission time control circuit, a first terminal of the on-off control circuit is electrically coupled to the driving current output terminal, a second terminal of the on-off control circuit is electrically coupled to the light-emitting element, and the on-off control circuit is configured to control the driving current output terminal to be coupled to, or decoupled from, the light-emitting element under control of a potential at the control terminal of the on-off control circuit; and the light-emission time control circuit is electrically coupled to a second gate line, light-emission control data lines, N light-emission time control signal output terminals and the control terminal of the on-off control circuit, and configured to control an $n^{th}$ light-emission time control signal output terminal to be coupled to, or decoupled from, the control terminal of the on-off control circuit in accordance with an $n^{th}$ light-emission control data voltage from an $n^{th}$ light-emission control data line under control of a second gate driving signal from the second gate line;

wherein the $n^{th}$ light-emission time control signal output terminal is configured to apply an $n^{th}$ light-emission time control signal, N is an integer larger than 1, and n is a positive integer smaller than or equal to N.

16. The display device according to claim 15, wherein the light-emission time control circuit comprises N light-emission time control sub-circuits, an $n^{th}$ light-emission time control sub-circuit is electrically coupled to the second gate line, the $n^{th}$ light-emission control data line, the $n^{th}$ light-emission time control signal output terminal and the control terminal of the on-off control circuit, and configured to write the $n^{th}$ light-emission control data voltage into an $n^{th}$ control node under control of the second gate driving signal from the second gate line, maintain a potential at the $n^{th}$ control node, and control the $n^{th}$ light-emission time control signal output terminal to be coupled to, or decoupled from, the control terminal of the on-off control circuit under control of the potential at the $n^{th}$ control node.

17. The display device according to claim 15, wherein N is equal to 2, and a first light-emission control data line and a second light-emission control data line are a same light-emission control data line;

the light-emission time control circuit comprises a fifth control transistor, a sixth control transistor, a seventh control transistor and a third capacitor;

a control electrode of the fifth control transistor is electrically coupled to the second gate line, a first electrode of the fifth control transistor is electrically coupled to the first light-emission control data line, and a second electrode of the fifth control transistor is electrically coupled to a control electrode of the sixth control transistor and a control electrode of the seventh control transistor;

a first terminal of the third capacitor is electrically coupled to the control electrode of the sixth control transistor, and a second terminal of the third capacitor is electrically coupled to a second voltage terminal;

a first electrode of the sixth control transistor is electrically coupled to a first light-emission time control signal output terminal, and a second electrode of the sixth control transistor is electrically coupled to the control terminal of the on-off control circuit; and a first electrode of the seventh control transistor is electrically coupled to a second light-emission time control signal output terminal, and a second electrode of the seventh control transistor is electrically coupled to the control terminal of the on-off control circuit.

18. The display device according to claim 15, wherein the on-off control circuit comprises an on-off control transistor; a control electrode of the on-off control transistor is the control terminal of the on-off control circuit, a first electrode of the on-off control transistor is electrically coupled to the driving current output terminal, and a second electrode of the on-off control transistor is electrically coupled to the light-emitting element.

19. The display device according to claim 15, wherein the pixel driving circuit comprises a driving sub-circuit, a data written-in sub-circuit, a light-emission control sub-circuit, an energy storage sub-circuit and a compensation sub-circuit, wherein the data written-in sub-circuit is electrically coupled to the first gate line, the display data line and a first terminal of the driving sub-circuit, and configured to write the display data voltage into the first terminal of the driving sub-circuit under control of the first gate driving signal;

the compensation sub-circuit is electrically coupled to the first gate line, a control terminal of the driving sub-circuit and a second terminal of the driving sub-circuit, and configured to control the control terminal of the driving sub-circuit to be coupled to, or decoupled from, the second terminal of the driving sub-circuit under control of the first gate driving signal;

a first terminal of the energy storage sub-circuit is electrically coupled to the control terminal of the driving sub-circuit, a second terminal of the energy storage sub-circuit is electrically coupled to the first voltage terminal, and the energy storage sub-circuit is configured to maintain a potential at the control terminal of the driving sub-circuit;

the light-emission control sub-circuit is electrically coupled to the light-emission control line, the first voltage terminal, the first terminal of the driving sub-circuit, the second terminal of the driving sub-circuit and the first terminal of the on-off control circuit, and configured to control the first voltage terminal to be coupled to, or decoupled from, the first terminal of the driving sub-circuit and control the second terminal of the driving sub-circuit to be coupled to, or decoupled from, the first terminal of the on-off control circuit under control of the light-emission control line; and the driving sub-circuit is configured to generate the driving current under control of the potential at the control terminal of the driving sub-circuit.

20. The display device according to claim 15, wherein the light-emitting element is a micro light-emitting diode, the second terminal of the on-off control circuit is electrically coupled to an anode of the micro light-emitting diode, and a cathode of the micro light-emitting diode is electrically coupled to a third voltage terminal.

* * * * *